US007497281B2

(12) United States Patent
Chen et al.

(10) Patent No.: US 7,497,281 B2
(45) Date of Patent: Mar. 3, 2009

(54) ROLLER CONE DRILL BITS WITH ENHANCED CUTTING ELEMENTS AND CUTTING STRUCTURES

(75) Inventors: Shilin Chen, The Woodlands, TX (US); James S. Dahlem, Midlothian, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 11/671,649

(22) Filed: Feb. 6, 2007

(65) Prior Publication Data

US 2007/0125579 A1 Jun. 7, 2007

Related U.S. Application Data

(60) Division of application No. 11/054,395, filed on Feb. 9, 2005, now Pat. No. 7,334,652, which is a continuation-in-part of application No. 10/189,305, filed on Jul. 2, 2002, now abandoned, which is a continuation of application No. 09/629,344, filed on Aug. 1, 2000, now Pat. No. 6,412,577, which is a continuation of application No. 09/387,304, filed on Aug. 31, 1999, now Pat. No. 6,095,262.

(60) Provisional application No. 60/549,354, filed on Mar. 2, 2004, provisional application No. 60/098,442, filed on Aug. 31, 1998.

(51) Int. Cl.
*E21B 10/16* (2006.01)

(52) U.S. Cl. ..... 175/374; 175/376; 175/378

(58) Field of Classification Search ..... 175/374, 175/376, 378

See application file for complete search history.

(56) References Cited

U.S. PATENT DOCUMENTS

| | | | | |
|---|---|---|---|---|
| 1,209,299 | A | 12/1916 | Hughes | |
| 1,263,802 | A | 4/1918 | Reed | |
| 1,394,769 | A | 10/1921 | Sorensen | |
| 1,847,981 | A | 3/1932 | Reed | |
| 2,038,386 | A | 4/1936 | Scott et al. | 255/71 |
| 2,117,679 | A | 5/1938 | Reed | 255/71 |
| 2,122,759 | A | 7/1938 | Scott | 255/71 |
| 2,132,498 | A | 10/1938 | Smith | 255/71 |
| 2,165,584 | A | 7/1939 | Smith et al. | 255/71 |

(Continued)

FOREIGN PATENT DOCUMENTS

CN 2082755 U 8/1991

(Continued)

OTHER PUBLICATIONS

MA Dekun, *The Operational Mechanics of the Rock Bit*, Petroleum Industry Press, Beijing, China, 1996.

(Continued)

*Primary Examiner*—Hoang Dang
(74) *Attorney, Agent, or Firm*—Baker Botts L.L.P.

(57) ABSTRACT

Roller cone drill bits are provided with cutting elements and cutting structures optimized for efficient drilling of soft and medium formations interspersed with hard stringers. The cutting elements and cutting structures may be satisfactorily used to drill downhole formations with varying amounts of hardness. The cutting elements and cutting structures may also be optimized to reduce tracking and increase wear resistance.

14 Claims, 7 Drawing Sheets

U.S. PATENT DOCUMENTS

| | | | | |
|---|---|---|---|---|
| 2,230,569 | A | 2/1941 | Howard et al. | 255/71 |
| 2,496,421 | A | 2/1950 | Stokes | 255/71 |
| 2,728,559 | A | 12/1955 | Boice et al. | 255/334 |
| 2,851,253 | A | 9/1958 | Boice | 255/347 |
| 4,056,153 | A | 11/1977 | Miglierini | 175/376 |
| 4,187,922 | A | 2/1980 | Phelps | 175/374 |
| 4,285,409 | A | 8/1981 | Allen | 175/336 |
| 4,334,586 | A | 6/1982 | Schumacher | 175/374 |
| 4,343,371 | A | 8/1982 | Baker, III et al. | 175/329 |
| 4,343,372 | A | 8/1982 | Kinzer | 175/374 |
| 4,393,948 | A | 7/1983 | Fernandez | 175/374 |
| 4,408,671 | A | 10/1983 | Munson | 175/377 |
| 4,427,081 | A | 1/1984 | Crawford | 175/376 |
| 4,455,040 | A | 6/1984 | Shinn | 285/142 |
| 4,611,673 | A | 9/1986 | Childers et al. | 175/340 |
| 4,627,276 | A | 12/1986 | Burgess et al. | 73/151 |
| 4,657,093 | A | 4/1987 | Schumacher | 175/353 |
| 4,738,322 | A | 4/1988 | Hall et al. | 175/329 |
| 4,776,413 | A | 10/1988 | Forsberg | 175/410 |
| 4,804,051 | A | 2/1989 | Ho | 175/26 |
| 4,815,342 | A | 3/1989 | Brett et al. | 76/108 |
| 4,848,476 | A | 7/1989 | Deane et al. | 175/340 |
| 4,889,017 | A | 12/1989 | Fuller et al. | 76/108 A |
| 5,010,789 | A | 4/1991 | Brett et al. | 76/108.2 |
| 5,027,913 | A | 7/1991 | Nquyen | 175/336 |
| 5,042,596 | A | 8/1991 | Brett et al. | 175/57 |
| 5,131,478 | A | 7/1992 | Brett et al. | 175/57 |
| 5,131,480 | A | 7/1992 | Lockstedt et al. | 175/374 |
| 5,137,097 | A | 8/1992 | Fernandez | 175/228 |
| 5,197,555 | A | 3/1993 | Estes | 175/374 |
| 5,216,917 | A | 6/1993 | Detournay | 73/151 |
| 5,224,560 | A | 7/1993 | Fernandez | 175/374 |
| RE34,435 | E | 11/1993 | Warren et al. | 175/398 |
| 5,285,409 | A | 2/1994 | Hwangbo et al. | 365/189.12 |
| 5,291,807 | A | 3/1994 | Vanderford | 76/108.2 |
| 5,305,836 | A | 4/1994 | Holbrook et al. | 175/39 |
| 5,311,958 | A | 5/1994 | Isbell et al. | 175/341 |
| 5,318,136 | A | 6/1994 | Rowsell et al. | 175/24 |
| 5,341,890 | A | 8/1994 | Cowthorne et al. | 175/374 |
| 5,351,770 | A | 10/1994 | Cawthorne et al. | 175/374 |
| 5,370,234 | A | 12/1994 | Sommer, Jr. et al. | 209/44.1 |
| 5,372,210 | A | 12/1994 | Harrell | 175/431 |
| 5,394,952 | A | 3/1995 | Johns et al. | 175/332 |
| 5,415,030 | A | 5/1995 | Jogi et al. | 73/151 |
| 5,416,697 | A | 5/1995 | Goodman | 364/422 |
| 5,421,423 | A | 6/1995 | Huffstutler | 175/374 |
| 5,456,141 | A | 10/1995 | Ho | 76/108.2 |
| 5,513,711 | A | 5/1996 | Williams | 175/57 |
| 5,579,856 | A | 12/1996 | Bird | 175/375 |
| 5,595,252 | A | 1/1997 | O'Hanlon | 175/57 |
| 5,595,255 | A | 1/1997 | Huffstutler | 175/331 |
| 5,605,198 | A | 2/1997 | Tibbitts et al. | 175/432 |
| 5,636,700 | A | 6/1997 | Shamburger, Jr. | 175/331 |
| 5,697,994 | A | 12/1997 | Packer et al. | 51/309 |
| 5,704,436 | A | 1/1998 | Smith et al. | 175/27 |
| 5,715,899 | A | 2/1998 | Liang et al. | 175/374 |
| 5,730,234 | A | 3/1998 | Putot | 175/50 |
| 5,767,399 | A | 6/1998 | Smith et al. | 73/152.11 |
| 5,794,720 | A | 8/1998 | Smith et al. | 175/40 |
| 5,812,068 | A | 9/1998 | Wisler et al. | 340/855.5 |
| 5,813,480 | A | 9/1998 | Zaleski, Jr. et al. | 175/40 |
| 5,813,485 | A | 9/1998 | Portwood | 175/430 |
| 5,839,526 | A | 11/1998 | Cisneros et al. | 175/431 |
| 5,853,245 | A | 12/1998 | Price | 384/96 |
| 5,967,245 | A | 10/1999 | Garcia et al. | 175/374 |
| 6,002,985 | A | 12/1999 | Stephenson | 702/13 |
| 6,003,623 | A | 12/1999 | Meiss | 175/430 |
| 6,012,015 | A | 1/2000 | Tubel | 702/6 |
| 6,021,377 | A | 2/2000 | Dubinsky et al. | 702/9 |
| 6,029,759 | A | 2/2000 | Sue et al. | 175/374 |
| 6,044,325 | A | 3/2000 | Chakravarthy et al. | 702/7 |
| 6,057,784 | A | 5/2000 | Schaaf et al. | 340/854.4 |
| 6,095,262 | A | 8/2000 | Chen | 175/57 |
| 6,095,264 | A | 8/2000 | Dillard | 175/331 |
| 6,109,368 | A | 8/2000 | Goldman et al. | 175/39 |
| 6,119,797 | A | 9/2000 | Hong et al. | 175/336 |
| 6,142,247 | A | 11/2000 | Pessier | 175/340 |
| 6,176,329 | B1 | 1/2001 | Portwood et al. | 175/341 |
| 6,213,225 | B1 | 4/2001 | Chen | 175/57 |
| 6,241,034 | B1 | 6/2001 | Steinke et al. | 175/331 |
| 6,260,635 | B1 | 7/2001 | Crawford | 175/371 |
| 6,269,892 | B1 | 8/2001 | Boulton et al. | 175/61 |
| 6,308,790 | B1 | 10/2001 | Mensa-Wilmot et al. | 175/73 |
| 6,348,110 | B1 | 2/2002 | Evans | 148/528 |
| 6,349,595 | B1 | 2/2002 | Civolani et al. | 73/152.02 |
| 6,374,930 | B1 | 4/2002 | Singh et al. | 175/374 |
| 6,401,839 | B1 | 6/2002 | Chen | 175/57 |
| 6,412,577 | B1 | 7/2002 | Chen | 175/57 |
| 6,499,547 | B2 | 12/2002 | Scott et al. | 175/374 |
| 6,516,293 | B1 | 2/2003 | Huang et al. | 703/10 |
| 6,527,068 | B1 | 3/2003 | Singh et al. | 175/431 |
| 6,533,051 | B1 | 3/2003 | Singh et al. | 175/371 |
| 6,581,699 | B1 | 6/2003 | Chen et al. | 175/61 |
| 6,607,047 | B1 | 8/2003 | Swadi et al. | 175/374 |
| 6,619,411 | B2 | 9/2003 | Singh et al. | 175/57 |
| 6,729,420 | B2 | 5/2004 | Mensa-Wilmot | 175/385 |
| 6,848,518 | B2 | 2/2005 | Chen et al. | 175/61 |
| 6,856,949 | B2 | 2/2005 | Singh et al. | 703/7 |
| 6,879,947 | B1 | 4/2005 | Glass | 703/10 |
| 7,020,597 | B2 | 3/2006 | Oliver et al. | 703/7 |
| 7,079,996 | B2 | 7/2006 | Stewart et al. | 703/8 |
| 7,147,066 | B2 | 12/2006 | Chen et al. | 175/61 |
| 2001/0042642 | A1 | 11/2001 | King | 175/40 |
| 2003/0195733 | A1 | 10/2003 | Huang et al. | 703/10 |
| 2004/0045742 | A1 | 3/2004 | Chen | 175/374 |
| 2004/0104053 | A1 | 6/2004 | Chen | 175/341 |
| 2004/0118609 | A1 | 6/2004 | Dennis | 175/57 |
| 2004/0167762 | A1 | 8/2004 | Chen | 703/10 |
| 2004/0254664 | A1 | 12/2004 | Centala et al. | 700/97 |
| 2005/0015230 | A1 | 1/2005 | Centala et al. | 703/10 |
| 2006/0032674 | A1 | 2/2006 | Chen et al. | 175/372 |
| 2006/0074616 | A1 | 4/2006 | Chen | 703/10 |

FOREIGN PATENT DOCUMENTS

| | | | |
|---|---|---|---|
| EP | 0384734 | A1 | 8/1990 |
| EP | 0511547 | A2 | 4/1992 |
| EP | 0511547 | A3 | 4/1992 |
| EP | 0511547 | B1 | 4/1992 |
| EP | 1006256 | | 6/2000 |
| GB | 2186715 | | 8/1987 |
| GB | 2241266 | A | 8/1991 |
| GB | 2 300 208 | A | 10/1996 |
| GB | 2305195 | A | 4/1997 |
| GB | 2327962 | | 2/1999 |
| GB | 2363409 | A | 6/2001 |
| GB | 2365899 | A | 2/2002 |
| GB | 2367578 | A | 4/2002 |
| GB | 2367579 | A | 4/2002 |
| GB | 2367626 | | 4/2002 |
| GB | 2384567 | | 7/2003 |
| GB | 2388857 | | 11/2003 |
| GB | 2400696 | | 10/2004 |
| RU | 1768745 | A1 | 10/1992 |
| SU | 1654515 | A1 | 3/1988 |
| SU | 1691497 | A1 | 5/1988 |
| SU | 1441051 | A2 | 11/1988 |

OTHER PUBLICATIONS

D. Ma, D. Zhou & R. Deng, *The Computer Stimulation of the Interaction Between Roller Bit and Rock*, (1995).

Shilin Chen, *Linear and Nonlinear Dynamics of Drillstrings*, 1994-1995.

D. Ma, & J.J. Azar, *Dynamics of Roller Cone Bits*, Dec. 1985.

D.K.Ma & S.L. Yang, *Kinamatics of the Cone Bit*, Jun. 1985.
Dma & J.J. Azar, *A New Way to Characterize the Gouging-Scraping Action of Roller Cone Bits*, 1989.
Russian bit catalog listing items "III 190,5 T-LIB-1" and "III 109,5 TKZ-LIB", prior 1997.
L.E. Hibbs, Jr., et al, *Diamond Compact Cutter Studies for Geothermal Bit Design*, Nov. 1978.
M.C. Sheppard, et al., "*Forces at the Teeth of a Drilling Rollercone Bit: Theory and Experiment*", Proceedings: 1988 SPE Annual Technical Conference and Exhibition; Houston, TX, USA, Oct. 2-5, 1988, vol. Delta, 1988, pp. 253-260 18042, XP002266080, Soc. Pet Eng AIME Pap SPE 1988 Publ by Soc of Petroleum Engineers of AIME, Richardson, TX, USA.
Adam T. Bourgoyne Jr et al., "*Applied Drilling Engineering*", Society of Petroleum Engineers Textbook Series, 1991.
Sutherland et al. "Development & Application of Versatile and Economical 3D Rotary Steering Technology" AADE, Emerging Technologies (pp. 2-16), 2001.
Plaintiff's Original Complaint for Patent Infringement and Jury Demand, filed Sep. 6, 2002 in the United States District Court for the Eastern District of Texas, Sherman Division, Civil Action No. 4-02CV269, *Halliburton Energy Services, Inc.* v. *Smith International, Inc.*, 4 pages.
Answer and Counterclaim of Smith International, filed Mar. 14, 2003, in the United States District Court for the Eastern District of Texas, Sherman Division, Civil Action No. 4-02CV269, *Hallilburton Energy Services, Inc.* v. *Smith International, Inc.*, 6 pages.
Response of Plaintiff and Counterclaim Defendant to Defendant's Counterclaim of Declaratory Judgment, filed Apr. 3, 2003, in the United States District Court for the Eastern District of Texas, Sherman Division, Civil Action No. 4-02CV269, *Halliburton Energy Services, Inc.* v. *Smith International, Inc.*, 3 pages.
First Amended Answer and Counterclaim of Smith International, filed Oct. 9, 2003, in the United States District Court for the Eastern District of Texas, Sherman Division, Civil Action No. 4-02CV269, *Halliburton Energy Services, Inc.* v. *Smith International, Inc.*, 8 pages.
J. P. Nguyen, "*Oil and Gas Field Development Techniques: Drilling*" (translation 1996, from French original 1993).
T.M. Warren et al, "*Drag-Bit Performance Modeling*", SPE Drill Eng. Jun. 1989, vol. 4, No. 2, pp. 119-127 15618, XP002266079.
"*Making Hole*", part of Rotary Drilling Series, edited by Charles Kirkley, 1983.
T.M. Warren, "*Factors Affecting Torque for A Roller Cone Bit*", JPT J PET Technol Sep. 1984, vol. 36, No. 10, pp. 1500-1508, XP002266078.
"*Drilling Mud*", part of Rotary Drilling Series, edited by Charles Kirkley, 1984.
H.G. Benson, "*Rock Bit Design, Selection and Evaluation*", presented at the spring meeting of the pacific coast district, American Petroleum Institute, Division of Production, Los Angeles, May 1956.
Memorandum Opinion of Judge Davis, signed Feb. 13, 2004, in the United States District Court for the Eastern District of Texas, Sherman Division, Civil Action No. 4-02CV269, *Halliburton Energy Services, Inc.* v. *Smith International, Inc.*, 37 pages (including fax coversheet), Feb. 19, 2004.
Final Judgment of Judge Davis, signed Aug. 13, 2004, in the United States District Court for the Eastern District of Texas, Sherman Division, Civil Action No. 4-02CV269, *Halliburton Energy Services, Inc.* v. *Smith International, Inc.* , 3 pages.
Sworn written statement of Stephen Steinke and Exhibits SS-1 to SS-6, Oct. 13, 2004.
J.C. Estes, "*Selecting the Proper Rotary Rock Bit*", Journal of Petroleum Technology, pp. 1359-1367, Nov. 1971.
D.K. Ma, *A New Method of Description of Scraping Characteristics of Roller Cone Bit, Petroleum Machinery*, Jul. 1988 (English translations with original Chinese version attached).
Wilson, C. Chin, *Wave Propagation in Petroleum Engineering*, 1994.
Sikarskie, et. al., "*Penetration Problems in Rock Mechanics*", American Society of Mechanical Engineers, Rock Mechanics Symposium, 1973.
Dykstra, et. al., "*Experimental Evaluations of Drill String Dynamics*", Amoco Report No. SPE 28323, 1994.
Kenner and Isbell, "*Dynamic Analysis Reveals Stability of Roller Cone Rock Bits*", SPE 28314, 1994.
Brochure entitled "*Twist & Shout*", (SB2255.1001), 4 pages.
Drawing No. A46079 Rock Bit and Hole Opener; Security Engineering Co., Inc., Whittier, California, Sep. 14, 1946.
"Machino Export", Russia, 4 pages, 1974.
R.K. Dropek, "A Study to Determine Roller Cone Cutter Offset Effects at Various Drilling Depths" American Society of Mechanical Engineers. 10 pages, Aug. 1, 1979.
U.S. Appl. No. 10/325,650, filed Dec. 19, 2002 by John G. Dennis, entitled Drilling with Mixed Tooth Types.
British Search Report for GB Patent Application No. 0504304.7, 4 pgs, Apr. 22, 2005.
British Search Report for GB Patent Application No. 0503934.2, 3 pgs, May 16, 2005.
B.L. Steklyanov, et al, "*Improving the Effectiveness of Drilling Tools*," Series KhM-3, Oil Industry Machine Building, pub. Central Institute for Scientific and Technical Information and Technical and Economic Research on Chemical and Petroleum Machine Buidling, Tsintikhimneftemash, Moscow translated from Russian), 1991.
Energy Balanced Series Roller Cone Bits, www.halliburton.com/oil_gas/sd1380.jsp.
Ashmore, et al., Stratapax™ Computer Program, Sandia Laboratories, Albuquerque, NM , (76 pages).
F.A.S.T.™ Technology Brochure entitled "*Tech Bits*", Security/Dresser Industries (1 page), Sep. 17, 1993.
Sii PLUS Brochure entitled "*The PDC Plus Advantage*", from Smith International (2 pages).
Specification sheet entitled "*SQAIR Quality Sub-Specification*", Shell Internationale Petroleum Mij. B.V., The Hauge, The Netherlands, 1991 (2 Pages).
Brochure entitled "*FM2000 Series—Tomorrow's Technolgoies for Today'Drilling*.", Security DBS, Dresser Industries, Inc., 1994 ( Pages).
Brochure entitled "*FS2000 Series—New Steel Body Technology Advances PDC Bit Performance and Efficiency*", Security DBS, Dresser Industries, Inc. (6 pages), 1997.
Communication of a Notice of Opposition filed Oct. 14, 2004, with the European Patent Office, mailed Oct. 21, 2004.
Brief Communication from European Patent Office enclosing letter from the opponent of Oct. 13, 2004, Oct. 22, 2004.
Composite Catalog of Oil Filed Equipment & Services, 27th Revision 1666-67 vol. 3, 1966.
Lecture Handouts, *Rock Bit Design, Dull grading, Selection and Application*, presented by Reed Rock bit Company, Oct. 16, 1980.
*Longer Useful Lives for Roller Bits Cuts Sharply into Drilling Costs*, South African Mining & Engineering Journal, vol. 90, pp. 39-43, Mar. 1979.
Rabia, H., *Oilwell Drilling Engineering: Priciples and Practice*, University of Newcastle upon Tyne, 331 pages, 1985.
Brief Communication from European Patent Office enclosing letter from the opponent dated Dec. 2, 2004.
Approved Judgement, Case No. HC 04 C 00114 00689 00690, Royal Courts of Justice, BEtween: Halliburton Energy Services, Inc. and (1) Smith International (North Sea) Limited (2) Smith International, Inc. (3) Smith International Italia SpA, Jul. 21, 2005.
W.C. Maurer, "The "Perfect-Cleaning" Theory of Rotary Drilling," Journal of Petroleum Technology, pp. 1175, 1270-1274, Nov. 1962.
Ma. D., et al. "*A New Method for Designing Rock Bit*", SPE Proceedings, vol. 22431, XP008058830, 10 pages, Mar. 24, 1992.
Notification of Great Britain Search Report for Application No. GB 0516638.4 (4 pages), Jan. 5, 2006.
Notification of Great Britain Search Report for Application No. GB 0523735.9 (3 pages), Jan. 31, 2006.
Communication from European Patent Office regarding opposition; Application No. 99945376.4-1266/1117894 through the Munich office (5 pages), Feb. 15, 2006.
Notification of European Search Report for Patent Application No. EP 04025560.6-2315 (4 pages), Feb. 24, 2006.
Notification of Eurpean Search Report for Patent Application No. EP 04025561.4-2315 (4 pages), Feb. 24, 2006.
Approved Judgment before Ho. Pumfrey, High Court of Justice, Chancery Division, Patents Court, Case HC04C00114, 00689, 00690, (*Halliburton* v. *Smith Internl.*), Royal Courts of Justice, Strand, London. (84 pages), Feb. 24, 2006.
Notification of European Search Report for Patent Application No. EP 04025562.2-2315 (4 pages), Feb. 24, 2006.
Notification of European Search Report for Patent Application No. EP 04025232.2-2315 (4 pages), Feb. 24, 2006.
Notification of European Search Report for Patent application No. 04025232.5-2315, pages, Apr. 4, 2006.
Notification of European Search Report for Patent application No. 04025234.8-2315, 3 pages, Apr. 4, 2006.
Notification of European Search Report for Patent application No. 04025233.0-2315, 3 pages, Apr. 11, 2006.
Patent Acts 1977: Error in Search Report, Application No. GB0516638.4, 2 pgs., May 24, 2006.
Decision revoking European Patent No. EP-B-1117894, 16 pgs., May 15, 2006.
Halliburton Revolutionizes PDC Drill Bit Design with the Release of FM3000, 2003 Press Releases, 2 pgs, Aug. 8, 2005.
D Stroud et al., "Development of the Industry's First Slimhole Point-the-Bit Rotary Steerable System," Society of Petroleum Engineers Inc, 4 pgs, 2003.
J.A. Norris, et al., "Development and Successful Application of Unique Steerable PDC Bits," Copyright 1998 IADC/SPE Drilling Confrence, 14 pgs, Mar. 3, 1998.
O. Vincke, et al., "Interactive Drilling: The Up-To-Date Drilling Technology," Oil & Gas Science and Technology Rev. IFP, vol. 59, No. 4, pp. 343-356, Jul. 2004.
Halliburton catalogue item entitled: EZ-Pilot (TM) Rotary Steerable System (1 page), Jul. 24, 2006.
Halliburton catalogue item entitled: Geo-Pilot (R) Rotary Steerable System (1 page), Jul. 24, 2006.
Halliburton catalogue item entitled: SlickBore (R) Matched Drilling System (1 page), Jul. 24, 2006.
International Search Report, PCT/US2006/030830, 11 pages, mailing date Dec. 19, 2006.
Menand et al., Classification of PDC Bits According to their Steerability, SPE, 11 pgs, 2003.
International Search Report, PCT/US2006/030803, 11 pgs, mailing date Dec. 19, 2006.
Hare et al., Design Index: A Systematic Method of PDC Drill-Bit Selection, SPE, 15 pgs., 2000.

FIG. 13
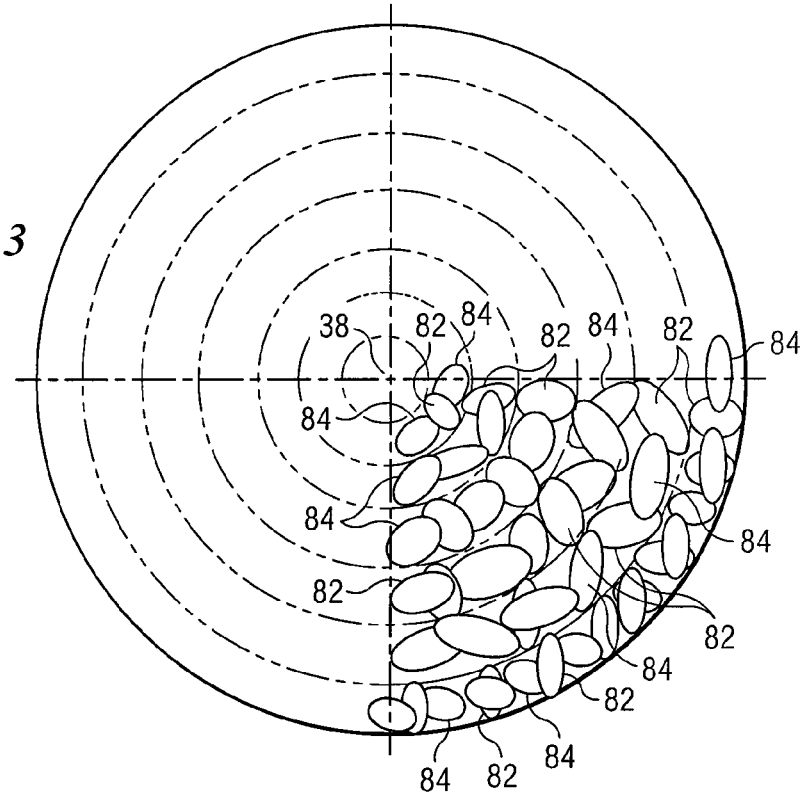
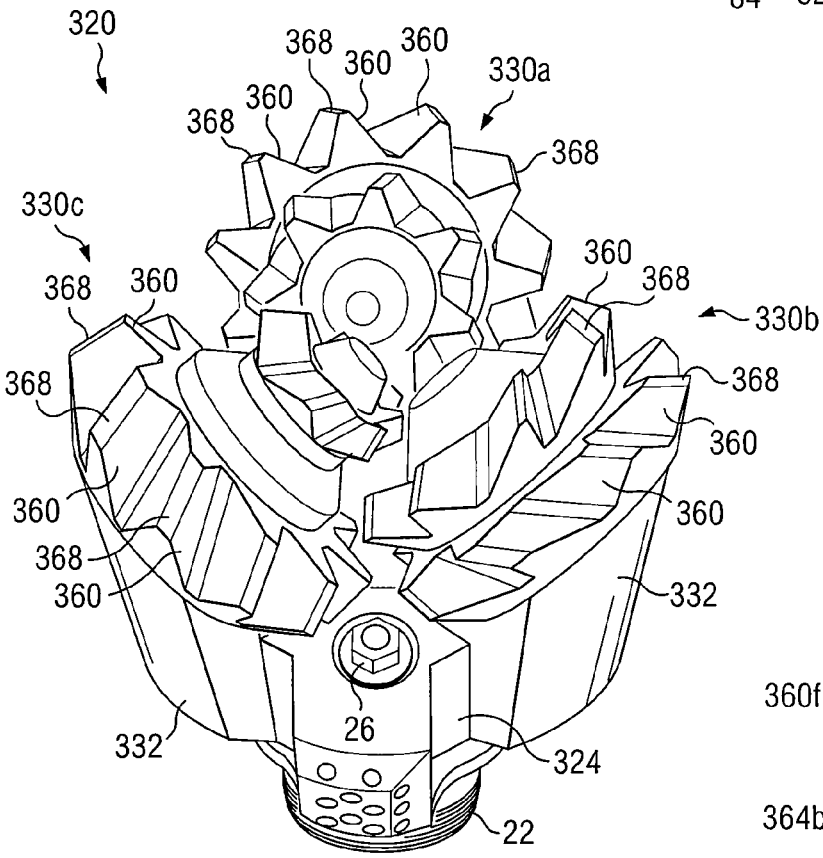
FIG. 15
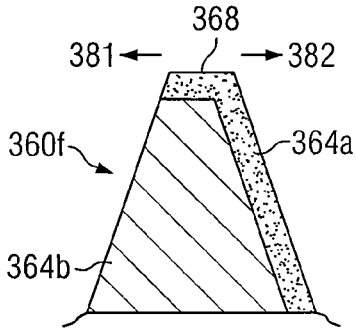
FIG. 16

ROLLER CONE DRILL BITS WITH ENHANCED CUTTING ELEMENTS AND CUTTING STRUCTURES

RELATED APPLICATION

This application is a divisional application of U.S. patent application Ser. No. 11/054,395 filed on Feb. 9, 2005 now U.S. Pat. No. 7,334,652; which is a continuation-in-part application of U.S. patent application Ser. No. 10/189,305 filed Jul. 2, 2002, now abandoned, and claims the benefit of U.S. Provisional Patent Application Ser. No. 60/549,354 filed Mar. 2, 2004; which is a continuation application of U.S. patent application Ser. No. 09/629,344 filed Aug. 1, 2000, now U.S. Pat. No. 6,412,577; which is a continuation of U.S. patent application Ser. No. 09/387,304 filed Aug. 31, 1999, now U.S. Pat. No. 6,095,262; which claims the benefit of U.S. Provisional Application No. 60/098,442 filed Aug. 31, 1998.

This application is to U.S. patent application Ser. No. 10/756,109 filed Jan. 13, 2004.

This application is to U.S. patent application Ser. No. 10/766,494 filed Jan. 28, 2004, now abandoned.

TECHNICAL FIELD

The present invention is related to roller cone drill bits used to form wellbores in subterranean formations and more particularly to arrangement and design of cutting elements and cutting structures for optimum performance of an associated drill bit.

BACKGROUND OF THE INVENTION

A wide variety of roller cone drill bits have previously been used to form wellbores in downhole formations. Such drill bits may also be referred to as "rotary" cone drill bits. Roller cone drill bits frequently include a bit body with three support arms extending therefrom. A respective cone is generally rotatably mounted on each support arm opposite from the bit body. Such drill bits may also be referred to as "tricone drill bits" or "rock bits".

A wide variety of roller cone drill bits have been satisfactorily used to form wellbores. Examples include roller cone drill bits with only one support arm and one cone, two support arms with a respective cone rotatably mounted on each arm and four or more cones rotatably mounted on an associated bit body. Various types of cutting elements and cutting structures such as compacts, inserts, milled teeth and welded compacts have also been used in association with roller cone drill bits.

Cutting elements and cutting structures associated with roller cone drill bits typically form a wellbore in a subterranean formation by a combination of shearing and crushing adjacent portions of the formation. The shearing motion may also be described as each cutting element scraping portions of the formation during rotation of an associated cone. The crushing motion may also be described as each cutting element penetrating portions of the formation during rotation of an associated cone. Within the well drilling industry it is generally accepted that shearing or scraping motion of a cutting element is a more efficient technique for removing a given volume of formation material from a wellbore as compared with a cutting element crushing or penetrating the same formation. Fixed cutter drill bits, sometimes referred to as drag bits or PDC drill bits, typically have cutting elements or cutting structures which only shear or scrape during contact with a formation. Therefore, fixed cutter drill bits are often used to form a wellbore in soft and medium formations.

Conventional roller cone drill bits often require more time to drill soft and medium formations as compared to fixed cutter drill bits.

The magnitude of the shearing motion or scraping motion associated with cutting structures of roller cone drill bits depends upon various factors such as the offset of each cone and associated cone profile. The magnitude of the crushing motion or penetrating motion associated with cutting structures of roller cone drill bits depends upon various factors such as weight on the bit, speed of rotation and geometric configuration of associated cutting structures and associated cone profiles. Roller cone drill bits designed for drilling relatively soft formations often have a larger cone offset value as compared with roller cone drill bits designed for drilling hard formations. Roller cone drill bits having cutting structures formed by milling rows of teeth on each cone are often used for drilling soft formations. Roller cone drill bits having cutting elements and cutting structures formed from a plurality of hard metal inserts or compacts are often used for drilling medium and hard formations. It is well known in the roller cone drill bit industry that drilling performance may be improved by orientation of cutting elements and cutting structures disposed on associated cones. Roller cone drill bits often remove a greater volume of formation material by shearing or scraping as compared with crushing or penetrating of the same formation.

SUMMARY OF THE DISCLOSURE

In accordance with teachings of the present disclosure, a roller cone drill bit may be formed with at least one cone having at least one row of cutting elements oriented such that the crest of one element extends generally perpendicular to an associated scraping direction and the crest of an adjacent cutting element extends generally parallel with the associated scraping direction. The remaining cutting elements in the one row are preferably arranged with alternating crests extending generally perpendicular to the associated scraping direction and parallel with the associated scraping direction.

Another aspect of the present invention includes providing a roller cone drill bit having at least one cone with at least one row of cutting elements oriented such that the crest of each cutting element is arranged generally perpendicular to an associated scraping direction. An adjacent row of cutting elements on the same cone may be oriented so that the crest of each cutting element extends generally parallel with the associated scraping direction.

A further embodiment of the present invention includes forming a roller cone drill bit having a gauge row formed on a first cone with the crest of each cutting element aligned generally perpendicular to an associated scraping direction to optimize volume of material removed from a formation by the gauge row. A gauge row may be formed on a second cone with the crest of each cutting element aligned generally parallel with an associated scraping direction to optimize penetration of the formation by the gauge row. A gauge row may be formed on a third cone with an alternating arrangement of cutting elements defined in part by the crest of one cutting element disposed generally perpendicular to the associated scraping direction and the crest of an adjacent cutting element disposed generally parallel with the associated scraping direction.

For some applications roller cone drill bits may be formed in accordance with teachings of the present invention with each cone having a plurality of cutting elements with different shapes, sizes and/or orientations. Also, one or more cutting elements may be formed from two or more different types of material.

Technical benefits of the present invention include forming roller cone drill bits which may be efficiently used to drill mixed formations of soft and hard materials. A roller cone drill bit formed in accordance with teachings of the present invention may include cutting structures which provide optimum scraping motion to remove relatively large volumes of material from soft formations. Portions of the cutting structures may extend generally parallel with the scraping motion to improve penetration or crushing of hard materials dispersed in the formation. Another aspect of the present invention includes forming cutting elements and cutting structures on a cone to produce void spaces or craters in the bottom of a wellbore to enhance fracturing and splitting of formation materials adjacent to the void spaces or craters. Cutting elements and cutting structures formed in accordance with teachings of the present invention may be used to reduce and/or eliminate tracking and vibration of associated cones.

Technical benefits of the present invention include providing roller cone drill bits with cutting elements and cutting structures operable to efficiently drill a wellbore in soft and medium formations with multiple hard stringers dispersed within both types of formations. Forming a roller cone drill bit with cutting elements and cutting structures incorporating teachings of the present invention may substantially reduce wear of associated cutting elements and cutting structures and increase downhole drilling life of the drill bit.

BRIEF DESCRIPTION OF THE DRAWINGS

A more complete and thorough understanding of the present embodiments and advantages thereof may be acquired by referring to the following description taken in conjunction with the accompanying drawings, in which like reference numbers indicate like features, and wherein:

FIG. 13 is a graphical representation showing one example of rows of crates formed in the bottom of a wellbore by a drill bit incorporating teachings of the present invention;

FIG. 15 is a schematic drawing showing an isometric view of a roller cone drill bit having milled teeth incorporating teachings of the present invention; and FIG. 16 is a schematic drawing in section with portions broken away of a milled tooth having different types of material in accordance with teachings of the present invention.

DETAILED DESCRIPTION OF THE INVENTION

Preferred embodiments of the invention and its advantages are best understood by reference to FIGS. 1-16 wherein like number refer to same and like parts.

The terms "cutting element" and "cutting elements" may be used in this application to include various types of compacts, inserts, milled teeth and welded compacts satisfactory for use with roller cone drill bits. The terms "cutting structure" and "cutting structures" may be used in this application to include various combinations and arrangements of cutting elements formed on or attached to one or more cone assemblies of a roller cone drill bit.

The terms "crest" and "longitudinal crest" may be used in this application to describe portions of a cutting element or cutting structure that makes initial contact with a downhole formation during drilling of a wellbore. The crest of a cutting element will typically engage and disengage the bottom of a wellbore during rotation of a roller cone drill bit and associated cone assemblies. The geometric configuration and dimensions of a crest may vary substantially depending upon specific design and dimensions of an associated cutting element or cutting structure.

As discussed later in more detail cutting elements and cutting structures formed in accordance with teachings of the present invention may have various designs and configurations. Cutting elements formed in accordance with teachings of the present invention will preferably include at least one crest.

Figure 1:
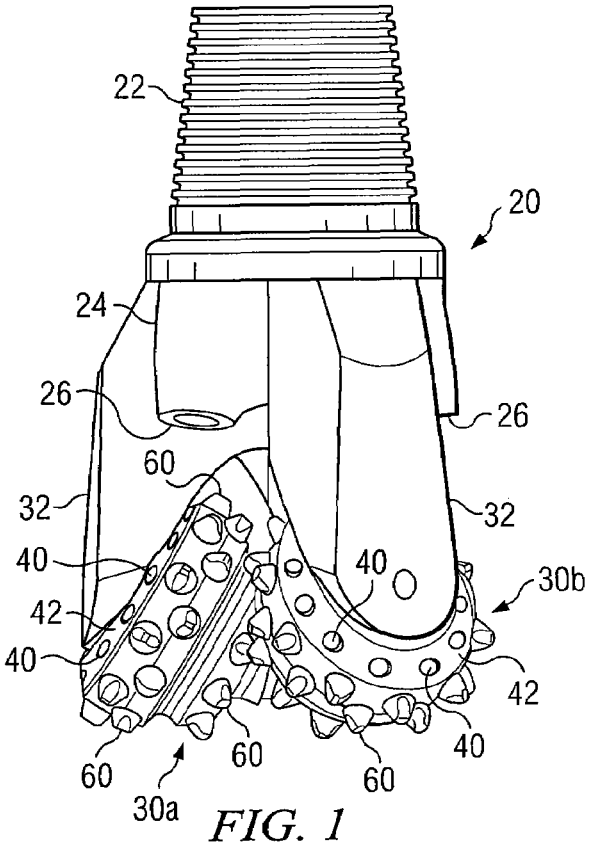
FIG. 1 is a schematic drawing showing an isometric view of a roller cone drill bit incorporating teachings of the present invention.

FIGS. 1 and 15 show examples of roller cone drill bits having one or more cone assemblies with cutting elements and cutting structures incorporating teachings of the present invention. The present invention may be used with roller cone drill bits having inserts or roller cone drill bits having milled teeth. The present invention may also be used with roller cone drill bits having cutting elements (not expressly shown) welded to associated cone assemblies.

A drill string (not expressly shown) may be attached to threaded portion 22 of drill bit 20 or drill bit 320 to both rotate and apply weight or force on associated cone assemblies 30 and 330. Cutting or drilling action associated with drill bits 20 and 320 occurs as cone assemblies 30 and 330 roll around the bottom of a wellbore. The inside diameter of the resulting wellbore corresponds approximately with the combined outside diameter or gauge diameter associated with cone assemblies 30 and 330. For some applications various types of downhole motors (not expressly shown) may also be used to rotate a roller cone drill bit incorporating teachings of the present invention. The present invention is not limited to roller cone drill bits associated with conventional drill strings.

For purposes of describing various features of the present invention cone assemblies 30 may be identified as 30*a*, 30*b* and 30*c*. Cone assemblies 330 may be identified as 330*a*, 330*b* and 330*c*. Cone assemblies 30 and 330 may sometimes be referred to as "rotary cone cutters", "roller cone cutters" or "cutter cone assemblies".

Roller cone drill bits 20 and 320 may be used to form a wellbore (not expressly shown) in a subterranean formation (not expressly shown) by cone assemblies 30 and 330 rolling around the bottom of the wellbore in response to rotation of an attached drill string. Roller cone drill bits 20 and 320 typically form boreholes by crushing or penetrating formation materials at the bottom of a borehole and scraping or shearing formation materials from the bottom of the borehole using cutting elements 60 and 360.

Roller cone drill bit 20 preferably includes bit body 24 having tapered, externally threaded portion 22 adapted to be secured to one end of a drill string. Bit body 24 preferably includes a passageway (not expressly shown) to communicate drilling mud or other fluids from the well surface through the drill string to attached drill bit 20. Drilling mud and other fluids may exit from nozzles 26. Formation cuttings and other debris may be carried from the bottom of a borehole by drilling fluid ejected from nozzles 26. The drilling fluid generally flows radially outward between the underside of roller cone drill bit 20 and the bottom of an associated borehole. The drilling fluid may then flow generally upward to the well surface through an annulus (not expressly shown) defined in part by the exterior of drill bit 20 and associated drill string and the inside diameter of the wellbore.

For embodiments of the present invention as represented by drill bit 20, bit body 24 may have three (3) substantially identical support arms 32 extending therefrom. The lower portion of each support arm 32 opposite from bit body 24 preferably includes respective shaft or spindle 34. Spindle 34 may also be referred to as a "bearing pin". Each cone assembly 30*a*, 30*b* and 30*c* preferably includes respective cavity 48 extending from backface 42. The dimensions and configuration of each cavity 48 are preferably selected to receive associated spindle 34. Portions of cavity 48 are shown in FIG. 2.

Cone assemblies 30*a*, 30*b* and 30*c* may be rotatably attached to respective spindles 34 extending from support arms 32. Each cone assembly 30*a*, 30*b* and 30*c* includes a respective axis of rotation 36 (sometimes referred to as "cone rotational axis") extending at an angle corresponding with the relationship between spindle 34 and associated support arm 32. Axis of rotation 36 often corresponds with the longitudinal center line of associated spindle 34.

Figure 2:
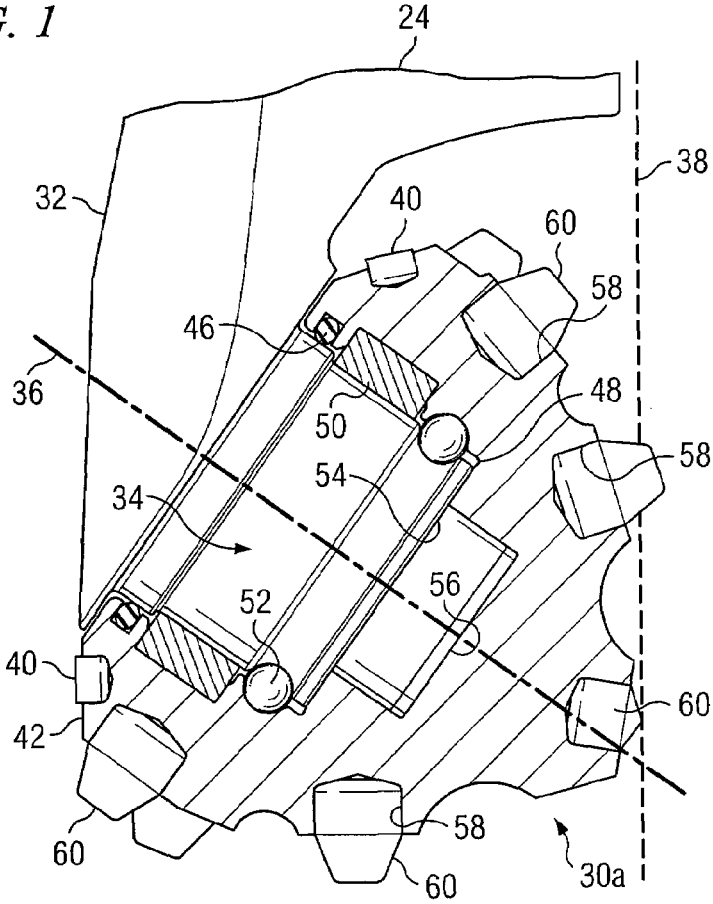
FIG. 2 is a schematic drawing in section and in elevations with portions broken away showing one example of a cone assembly incorporating teachings of the present invention rotatably mounted on a support arm.

For embodiments shown in FIGS. 1 and 2 a plurality of compacts 40 may be disposed in backface 42 of each cone assembly 30*a*, 30*b* and 30*c*. Compacts 40 may be used to "trim" the inside diameter of a borehole and prevent other portions of backface 42 from contacting the adjacent formation. For some applications compacts 40 may be formed from polycrystalline diamond type materials or other suitable hard materials. Each cone assembly 30*a*, 30*b* and 30*c* includes a plurality of cutting elements 60 arranged in respective rows. A gauge row of cutting elements 60 may be disposed adjacent to backface 42 of each cone assembly 30*a*, 30*b* and 30*c*. The gauge row may sometimes be referred to as the "first row" of inserts.

Compacts 40 and cutting elements 60 may be formed from a wide variety of hard materials such as tungsten carbide. The term "tungsten carbide" includes monotungsten carbide (WC), ditungsten carbide ($W_2C$), macrocrystalline tungsten carbide and cemented or sintered tungsten carbide. Examples of hard materials which may be satisfactorily used to form compacts 40 and cutting elements 60 include various metal alloys and cermets such as metal borides, metal carbides, metal oxides and metal nitrides. An important feature of the present invention includes the ability to select the type of hard material which provides desired abrasion, wear and erosion resistance in a cost effective, reliable manner and provides optimum downhole drilling performance.

FIG. 2 shows portions of support arm 32 with cone assembly 30*a* rotatably mounted on spindle 34. Cone assembly 30*a* may rotate about cone rotational axis 36 which tilts downwardly and inwardly at an angle relative to rotational axis 38 of drill bit 20. Elastomeric seal 46 may be disposed between the exterior of spindle 34 and the interior of cylindrical cavity 48. Cavity 48 contains generally cylindrical surfaces sized to receive corresponding exterior surfaces associated with spindle 34. Seal 46 forms a fluid barrier between exterior portions of spindle 34 and interior portions of cavity 48 to retain lubricants within cavity 48 and bearings 50 and 52. Seal 48 also prevents infiltration of formation cuttings into cavity 48. Seal 46 protects associated bearings 50 and 52 from loss of lubricant and from contact with debris and thus prolongs the downhole life of drill bit 20.

Bearing 50 supports radial loads associated with rotation of cone assembly 30*a* relative to spindle 34. Thrust bearings 54 support axial loads associated with rotation of cone assembly 30*a* relative to spindle 34. Bearings 52 may be used to securely engage cone assembly 30*a* with spindle 34.

Figure 3:
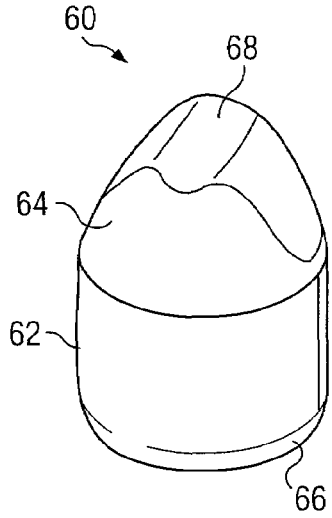
FIG. 3 is a schematic drawing showing one example of an insert satisfactory for use with a roller cone drill bit incorporating teachings of the present invention.

FIG. 3 shows one example of a cutting element satisfactory for use with a roller cone drill bit incorporating teachings of the present invention. Each cone assembly 30*a*, 30*b* and 30*c* may include a plurality of cutting elements 60 arranged in accordance with teachings of the present invention. Each cutting element 60 may include generally cylindrical body 62 with generally chisel shaped extension 64. Lower portion 66 of cylindrical body 62 may be designed to fit within corresponding sockets or openings 58 formed in cone assemblies 30*a*, 30*b* and 30*c*. For some applications cylindrical body 62 and chisel shaped extension 64 may be formed as integral components. Various types of press fitting techniques or other suitable methods may be satisfactorily used to securely engage each cutting element 60 with respective socket or opening 58. Cutting element 60 may be generally described as an insert.

For embodiments shown in FIGS. 1-3 extension 64 may be described as having a "chisel shaped" configuration defined in part by crest 68. Cylindrical body 62 may be modified to have an oblong or oval cross section. Also, extension 64 may have various configurations.

Figure 4A:
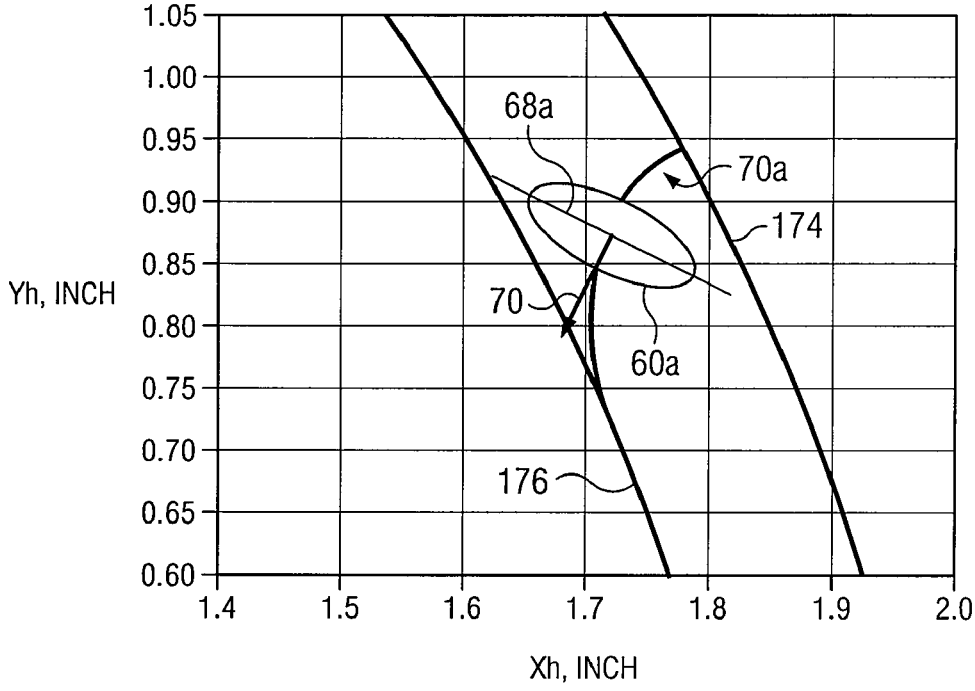
FIG. 4A is a graphical representation of a cutting element disposed on a roller cone drill bit and oriented for optimum removal of a formation material by shearing or scraping motion.
Figure 4B:
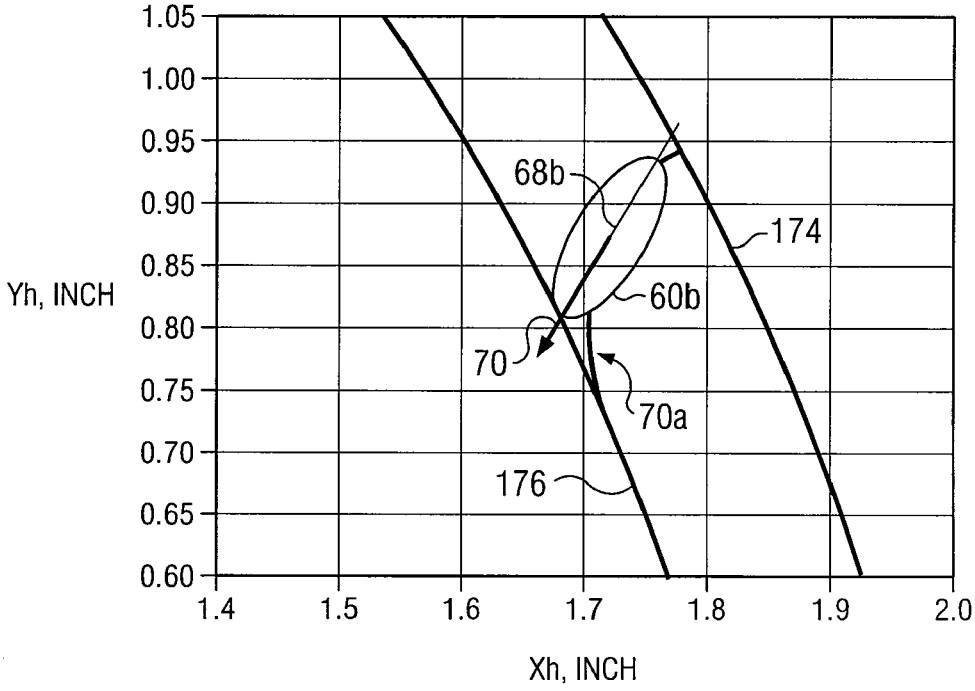
FIG. 4B is a graphical representation of a cutting element disposed on a roller cone drill bit and oriented for optimum penetration or crushing a hard formation.

FIGS. 4A and 4B are graphical representations showing relative movement of cutting elements 60*a* and 60*b* during rotation of roller cone drill bit 20 at the bottom of a wellbore. The graphs shown in FIGS. 4A and 4B are based on a bit coordinate system in which the Z axis corresponds generally with the axis of rotation of an associated roller cone drill bit (sometimes referred to as "drill bit rotational axis"). Axes $X_h$ and $Y_h$ coordinates are for the borehole.

Based on various factors such as dimensions of drill bit 20, offset angle of each cone assembly 30*a*, 30*b* and 30*c*, specific location of each cutting element 60 on cone assemblies 30*a*, 30*b* and 30*c*, movement of each cutting element 60 along a respective path or track will vary relative to rotational axis 38 of drill bit 20. Curved path 70*a* as shown in FIGS. 4A and 4B is representative of such movement. Lines 174 and 176 as shown in FIGS. 4A and 4B correspond generally with boundary lines of a scraping area associated with one row of cutting elements 60*a* and 60*b*. Lines 174 and 176 are generally circular. The center of each circle represented in part by lines 174 and 176 corresponds generally with the center of an associated wellbore. For example see FIGS. 13 and 14A.

Each cone assembly 30*a*, 30*b* and 30*c* and associated cutting elements 60 will have a respective orientation and scraping direction associated with optimum removal of material from a downhole formation and a respective orientation for optimum crushing or penetration of the downhole formation relative to the scraping direction. Arrows 70 will be used throughout this application to indicate the optimum scraping direction for removal of formation material by an associated cutting element. The optimum scraping direction may vary from one row of cutting elements to the next row of cutting elements on each cutter cone assembly. See FIGS. 7 and 8.

Various techniques may be used to determine optimum orientation of cutting elements and associated scraping for removal of material from a downhole formation using roller cone drill bits. U.S. Pat. No. 6,095,262 entitled "Roller-Cone Bits, Systems, Drilling Methods, And Design Methods With Optimization Of Tooth Orientation" discloses examples of some techniques for optimizations based in part on determining radial and tangential scraping motion of inserts or teeth during engagement of a roller cone bit with a downhole formation. For some applications equivalent tangent scraping distance and equivalent radial scraping distance along with calculations of ratios between drill bit rotation speed and cone rotation speed may be used to determine optimum orientation of cutting elements and associated scraping direction for removal of material from a downhole formation. Depending upon specific design characteristic of each cutting element such as size and configuration of an associated crest, the orientation of the crest of a cutting element for optimum penetration of a formation may be approximately perpendicular to the optimum orientation of the crest of the same cutting element for removal of material from the same formation.

FIG. 4A is a graphical representation showing cutting element 60*a* with associated crest 68*a* extending generally perpendicular with respect to optimum scraping direction 70. FIG. 4B shows cutting element 60*b* with crest 68*b* aligned substantially parallel with optimum scraping direction 70 which will typically provide optimum penetration or crushing of an adjacent formation. One of the features of the present invention includes orienting adjacent cutting elements 60 with one crest aligned approximately perpendicular with the optimum scraping direction (see FIG. 4A) and an adjacent cutting element with its crest aligned substantially parallel with the optimum scraping direction (See FIG. 4B). As a result, the crest of one cutting element may be disposed approximately perpendicular with crest of an adjacent cutting element.

Figure 5:
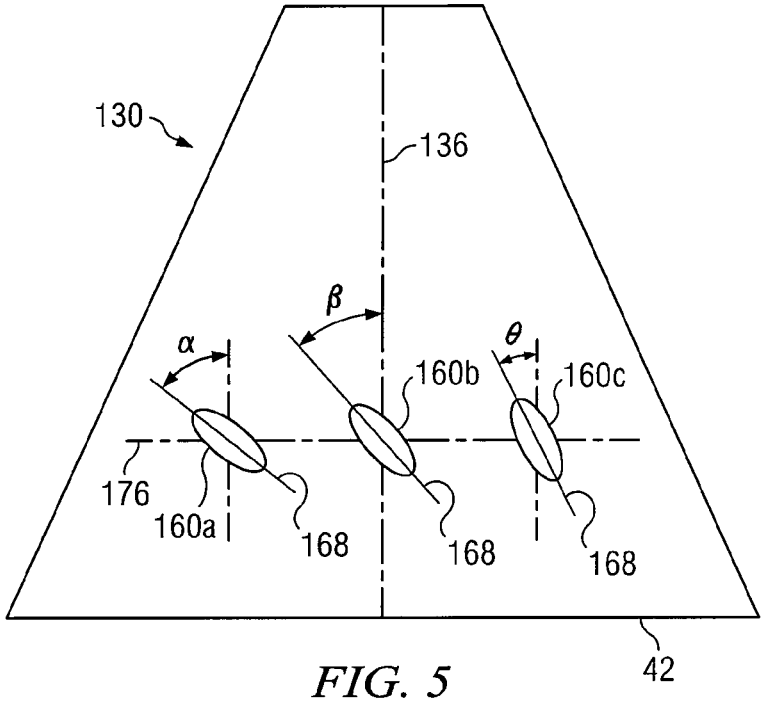
FIG. 5 is a schematic drawing showing one example of cutting elements oriented to minimize tracking of a conventional roller cone drill bit.

Conventional roller cone drill bits have frequently been formed with cutting elements oriented at different angles relative to each other to minimize tracking of the cutting elements during rotation of the drill bit. FIG. 5 shows one example of a conventional cone assembly 130 with cutting elements 160*a*, 160*b* and 160*c* disposed in row 176 formed on the exterior thereof. Respective crests 168 on cutting elements 160*a*, 160*b* and 160*c* may be disposed at various angles relative to cone rotational axis 136.

Figure 6A:
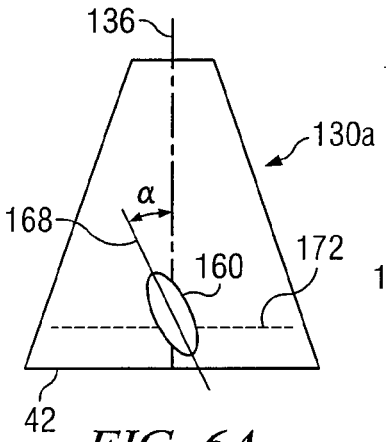
FIGS. 6A, 6B and 6C are schematic drawings showing one example of cutting structures oriented to minimize tracking of a conventional roller cone drill bit.
Figure 6B:
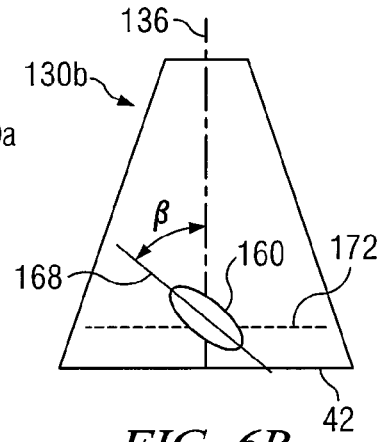
Figure 6C:
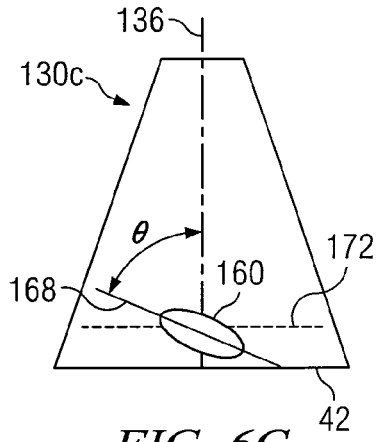

FIGS. 6A, 6B and 6C are schematic representations of three (3) cone assemblies 130*a*, 130*b* and 130*c* associated with a conventional roller cone drill bit. For this example, each cone assembly 130*a*, 130*b* and 130*c* includes respective row 172 with cutting elements 160 disposed at various angles relative to associated cone rotational axis 136. Varying the angle between each crest 168 and respective rotation axis 136 may reduce tracking of the cutting elements 160 or engagement with previously formed craters at the bottom of a wellbore.

Figure 7:
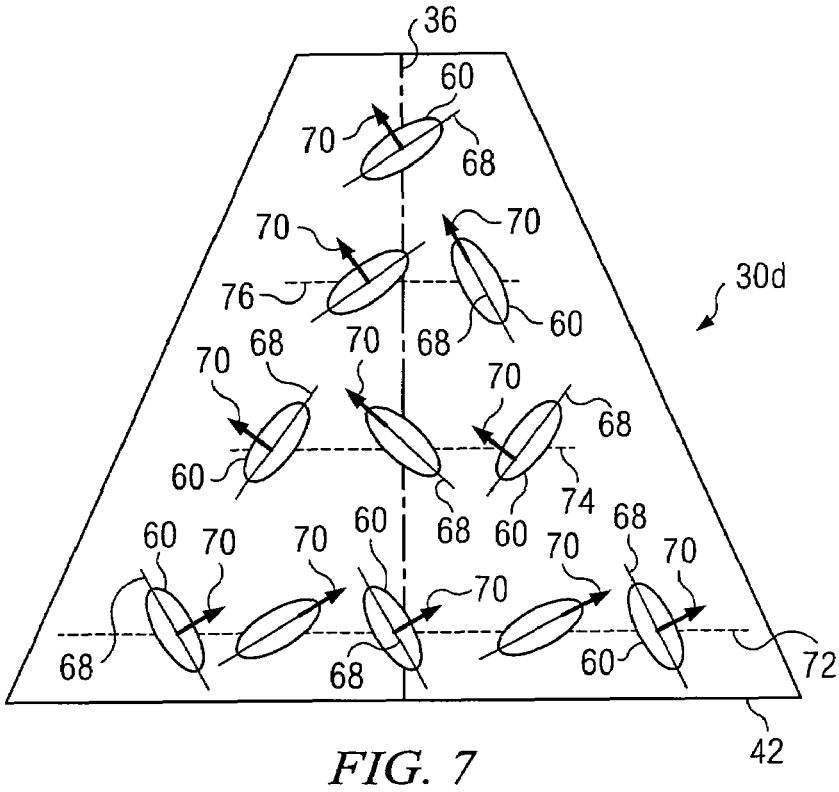
FIG. 7 is a schematic drawing showing one example of cutting elements disposed on a cone in accordance to teachings of the present invention to optimize both shearing and crushing of formation materials at the bottom of a wellbore.
Figure 8:
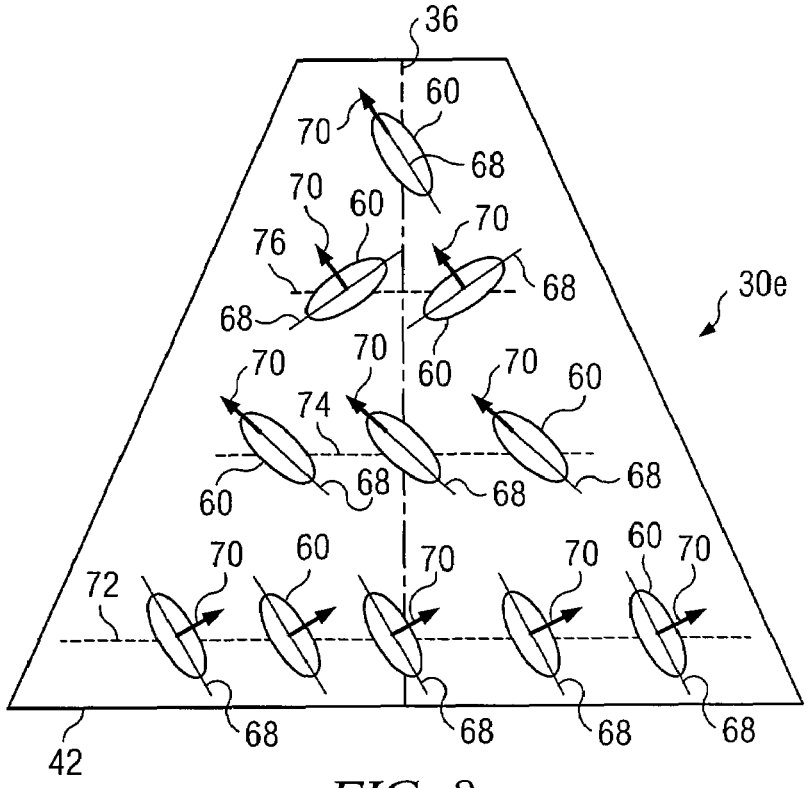
FIG. 8 is a schematic drawing showing another orientation of cutting elements disposed on a cone in accordance with teachings of the present invention to optimize both shearing and crushing of formation materials at the bottom of a wellbore.

FIGS. 7 and 8 are schematic drawings showing examples of cutting elements 60 disposed on cone assemblies 30*d* and 30*e* in accordance with teachings of the present invention. For embodiments shown in FIGS. 7 and 8 cutting elements 60 may be arranged in respective rows 72, 74 and 76. First row or gauge row 72 is preferably disposed adjacent to associated backface 42. Arrows 70 indicate the optimum scraping direction for each cutting element 60. The orientation of arrows 70 demonstrates that the optimum scraping direction may vary from one row of cutting elements to the next row of cutting elements on the same cone assembly.

For embodiments represented by cone assembly 30*d* first row or gauge row 72 preferably includes at least one cutting element 60 with its associated crest 68 extending generally perpendicular with respect to optimum scraping direction 70. Crest 68 of an adjacent cutting element 60 may be oriented parallel with optimum scraping direction 70.

Accordingly, the crests 68 of the at least one cutting element and the adjacent cutting element 68 are oriented at approximately ninety degrees relative to one another. In some embodiments, the orientations of the at least one cutting element crest 68 on the adjacent cutting element crest 68 may vary such that the orientation of the crests 68 may vary by ninety (90) degrees, with a variation of up to ten (10) degrees. In other embodiments, the variation in orientation of alternating crests 68 may be up to twenty (20) or thirty (30) degrees from the ninety (90) degree variation in orientation between alternating crests 68 described above.

For some applications cutting elements 60 may be disposed in second row 74 and third row 76 with a similar alternating pattern defined by crest 68 of one cutting element 60 extending generally perpendicular with respect to optimum scraping direction 70 and crest 68 of an adjacent cutting element 60 extending generally parallel with respect to optimum scraping direction 70.

FIG. 8 is a schematic drawing showing another example of cutting elements 60 disposed on cutter cone assembly 30*e* in accordance with teachings of the present invention. For embodiments represented by cone assembly 30*e*, cutting elements 60 in gauge row 72 are preferably disposed with each crest 68 extending generally perpendicular with respect to optimum scraping direction 70. In second row 74 each cutting element 60 is preferably aligned with respective crest 68 extending generally parallel with optimum scraping direction 70. In third row 76 crest 68 of each cutting element 60 is preferably aligned substantially perpendicular with optimum scraping direction 70. For some applications cutting elements 60 disposed in gauge row 74 may have smaller dimensions and be formed from stronger materials as compared with cutting elements 60 disposed in rows 74 and 76. for such applications, crests 68 for cutting elements 60 having smaller dimensions may be shorter in length than the crests of cutting elements 60 with larger dimensions. While such applications include cutting elements of different dimensions, in some preferred embodiments the cutting elements of differing dimensions have a generally consistent height or distance between the crest and the surface of the cone.

Benefits of the present invention include recognizing that the optimum scraping direction may vary from one row of cutting elements to the next row of cutting elements on the same cutter cone assembly and orientating cutting elements and respective crests to provide either enhanced penetration or crushing of a formation or scraping or shearing for optimum removal of formation materials. The present invention also includes forming cutting elements with optimum dimensions and configurations for enhanced drilling efficiency.

Figure 9A:
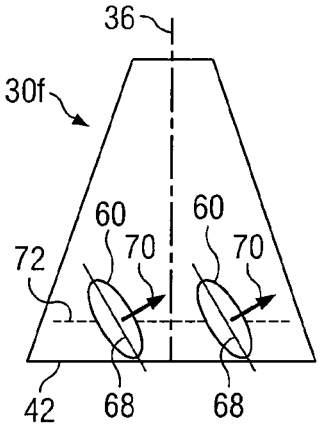
FIGS. 9A, 9B and 9C are schematic drawings showing one example of cutting elements orientated on three cones of a roller cone drill bit in accordance with teachings of the present invention to optimize both shearing and crushing of a subterranean formation.
Figure 9B:
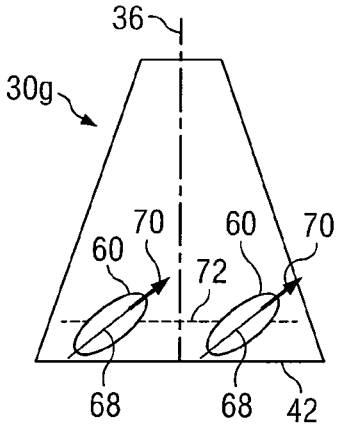
Figure 9C:
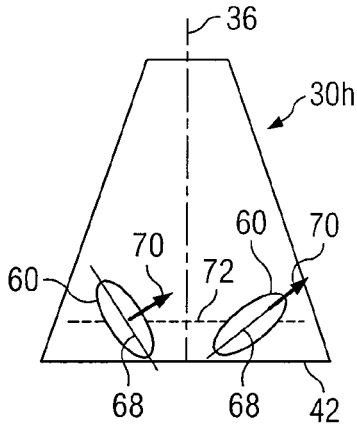

FIGS. 9A, 9B and 9C are schematic representations of three (3) cone assemblies 30*f*, 30*g*, and 30*h* associated with a roller cone drill bit incorporating teachings of the present invention. Each cone assembly 30*f*, 30*g* and 30*h* includes respective cone rotational axis 36 and a plurality of cutting elements 60. Each cone assembly 30*f*, 30*g* and 30*h* also includes respective gauge row 72. For embodiments shown in FIGS. 9A, 9B and 9C cutting elements 60 in gauge row 72 of cone assembly 30*f* are preferably disposed with each crest 68 extending generally perpendicular with respect to optimum scraping direction 70. Cutting elements 60 are preferably disposed in gauge row 72 of cone assembly 30*g* with each crest 68 extending substantially parallel with optimum scraping direction 70. Cutting elements 60 in gauge row 72 of cone assembly 30*h* are preferably disposed in an alternating pattern with one crest 68 disposed generally perpendicular with optimum scraping direction 70 and adjacent cutting element 60 with associated crest 68 disposed generally parallel with optimum scraping direction 70. For some applications gauge row 72 or cone assembly 30*f* may contain nineteen (19) cutting elements 60. Gauge rows 72 of cone assemblies 30*g* and 30*h* may contain respectively thirteen (13) and fifteen (15) cutting elements 60.

Technical benefits of the present invention include selecting the number of cutting elements disposed in the gauge row of three (3) cone assemblies to optimize removal of formation materials and the number of cutting elements disposed to enhance penetration of the formation by a roller cone drill bit. Embodiments represented by FIGS. 9A, 9B and 9C may result in substantially equal formation removal and formation penetration. For some relatively soft formations the number of cutting elements aligned for optimum formation removal may be increased and the number of cutting elements aligned for enhanced formation penetration may be decreased. For harder formations the number of cutting elements aligned for optimum removal of formation materials may be decreased and the number of cutting elements aligned for enhanced penetration of the formation may be increased. Also, the number of cutting elements in each gauge row may be varied for optimum drilling efficiency.

Figure 10:
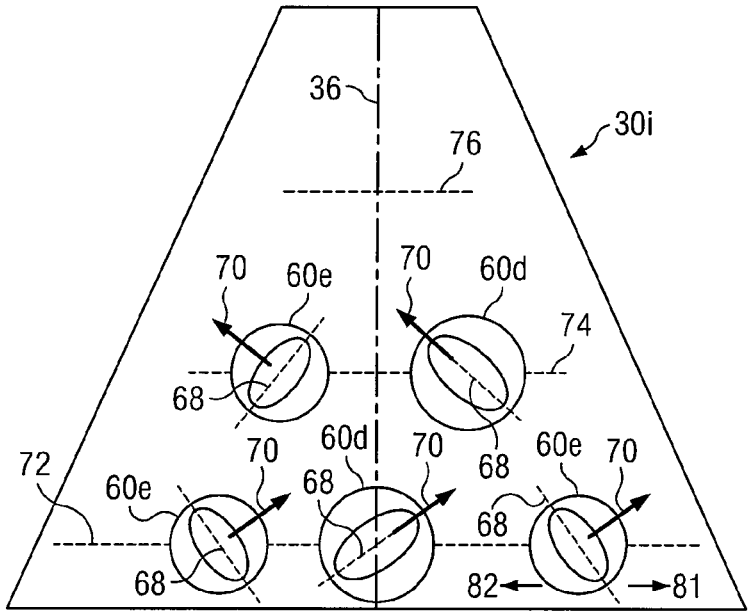
FIG. 10 is a schematic drawing showing orientation of cutting elements and variations in the size of cutting elements in accordance to teachings of the present invention to optimize both shearing and crushing of a subterranean formation and to reduce wear of the associated cutting structure.

FIG. 10 is a schematic representation of cone assembly 30*i* having a plurality of cutting elements 60*d* and 60*e* disposed thereon in accordance with teachings of the present invention. Cone assembly 30*i* preferably includes rows 72, 74 and 76 of cutting elements 60*d* and 60*e*. For this embodiment cutting elements 60*d* may have a larger diameter as compared with cutting elements 60*e*. Crest 68 of each cutting element 60*d* may be aligned substantially parallel with optimum scraping direction 70 to provide enhanced penetration of a formation. Cutting elements 60*e* may have respective crests 68 extending generally perpendicular with optimum scraping direction 70 in an alternating sequence with associated cutting elements 60*d*. The dimensions of cutting elements 60*e* may be selected such that the volume of material removed by cutting elements 60*e* corresponds approximately with penetration of the formation by cutting element 60*d*.

For other types of formations cutting element 60*e* aligned generally perpendicular with the optimum scraping direction 70 may be larger than cutting elements 60*d* extending generally parallel with optimum scraping direction 70. Technical benefits of the present invention include varying the size of cutting elements to optimize formation penetration, removal of formation materials and downhole drilling life of the associated cutting elements based on factors such as overall formation hardness and any variations in formation hardness.

Figure 11A:
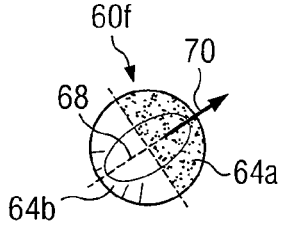
FIGS. 11A and 11B are schematic drawings in section showing examples of cutting elements formed with different types of material in accordance to teachings of the present invention.
Figure 11B:
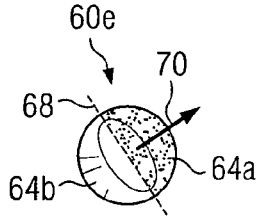

FIGS. 11A and 11B are schematic representations of two cutting elements (2) 60*f* and 60*g* incorporating teachings of the present invention. In FIG. 11A cutting element 60*f* is shown with longitudinal crest 68 aligned generally parallel with optimum scraping direction 70 to enhance formation penetration. Cutting elements typically include a leading edge and a trailing edge defined in part by impact with a formation. Cutting element 60*f* may be formed with relatively hard materials in leading portion 64*a* as compared with the materials used to form trailing portion 64*b*. As a result of this arrangement, leading portion 64*a* may have an increased life as compared with forming leading portion 64*a* from softer materials used to form trailing portion 64*b*. Generally hard materials are more expensive than soft materials. Therefore, relatively more expensive material may be used to form leading portion 64*a* and less expensive materials may be used to form trailing portion 64*b*. For example, leading portion 64*a* may have a higher concentration of diamond like materials and trailing portion 64*b* may have a lower concentration of diamond like materials.

In FIG. 11B cutting element 60*g* is shown with longitudinal crest 68 aligned generally perpendicular with optimum scraping direction 70 to enhance removal of formation materials. Leading portion 64*a* of cutting element 60*g* may be formed with relatively hard materials as compared with the materials used to form trailing portion 64*b*. As a result of forming extension 64 of cutting element 60*g* in accordance with teachings of the present invention, leading portion 64*a* may have an increased life as compared with using the softer materials associated with trailing portion 64*b*.

The present invention allows placing a greater concentration of hard materials which are often more expensive than other materials associated with forming a cutting element adjacent to the leading edge to provide enhanced resistance to abrasion and wear. For some applications there may be advantages to using relatively soft material to form the leading portion of a cutting element and harder material to form the trailing portion of the cutting element. This arrangement will be discussed with respect to cutting element 360*f* of FIG. 16.

FIGS. 10, 11A and 11B show using relatively large inserts for penetration of a formation and relatively small inserts for enhanced volume removal. For some applications, particularly very hard formations, there may be benefits to using a larger number of relatively small inserts oriented for enhanced penetration and crushing of a formation and a smaller number of larger inserts oriented for optimum removal of formation materials.

Figure 12A:
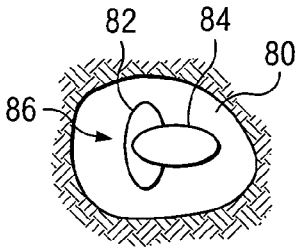
FIGS. 12A, 12B and 12C are schematic drawings showing examples of patterns of void spaces or craters which may be formed in a formation by a roller cone drill bit incorporating teachings of the present invention.
Figure 12B:
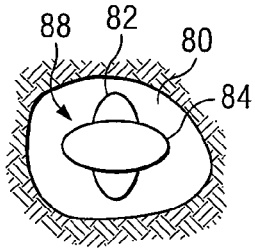
Figure 12C:
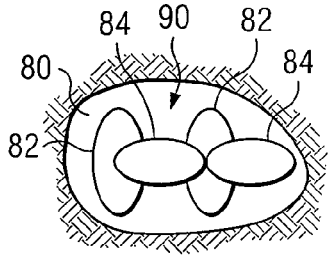

FIGS. 12A, 12B and 12C are schematic drawings showing examples of craters which may be formed at the bottom 80 of a wellbore by a roller cone drill bit incorporating teachings of the present invention. FIG. 12A shows an example of crater 82 formed by a cutting element oriented in a direction for optimum removal of formation materials. Crater 84 may be formed by a cutting element oriented for enhanced penetration of a formation in accordance with teachings of the present invention. Crater 82 and crater 84 may be formed by cutting elements of different roller cones of the bit or may be formed by cutting elements that are disposed on the same roller cone. The combined craters 82 and 84 produce generally "T shaped" crater 86. FIG. 12B shows the results of orienting cutting elements in accordance with teachings of the present invention such that craters 82 and 84 may form general "cross shaped" crater 88. FIG. 12C shows the results of multiple impacts of cutting elements to produce a series of connected craters 82 and 84 which produce row 90 of "H shaped" craters.

Technical benefits of the present invention include forming craters 82 and 84 in a wellbore to optimize fracturing and splitting of adjacent formation materials. Cutting elements may also be oriented to increase fracturing or splitting of any formation materials extending between or "bridging" adjacent craters 82 and 84. The size and configuration of the cutting elements may be varied to minimize the presence of bridging materials.

FIG. 13 is a graphical representation showing one example of generally circular rows of craters or rings formed in the bottom of a wellbore by a drill bit incorporating teachings of the present invention. As previously discussed with respect to FIGS. 12A, 12B and 12C, the present invention allows orienting cutting elements to produce craters 82 for optimum removal of formation materials and craters 84 for enhanced penetration of the formation. During rotation of an associated drill bit the cutting elements will preferably engage the bottom of a wellbore to produce cut rings defined in part by craters 82 and 84. For example the outer most ring of craters 82 and 84 as shown in FIG. 13 would be produced by cutting elements disposed in the gauge rows of associated cone assemblies. The width of each cut ring corresponds approximately with the effective width of associated crests 68 aligned for optimum removal of formation materials.

The distance between adjacent cutting elements 60 in each row may be reduced to minimize the presence of any bridging materials between resulting craters 82 and 84. The spacing between adjacent rows of cutting elements may be adjusted in accordance with teachings of the present invention to minimize the presence of any bridging materials between one ring of craters 82 and 84 and an adjacent ring of craters 82 and 84. Cutting elements may also be oriented in accordance with teachings of the present invention such that enhanced penetration of a formation results in increased fracturing and splitting of bridging materials to allow even more efficient formation removal.

Figure 14A:
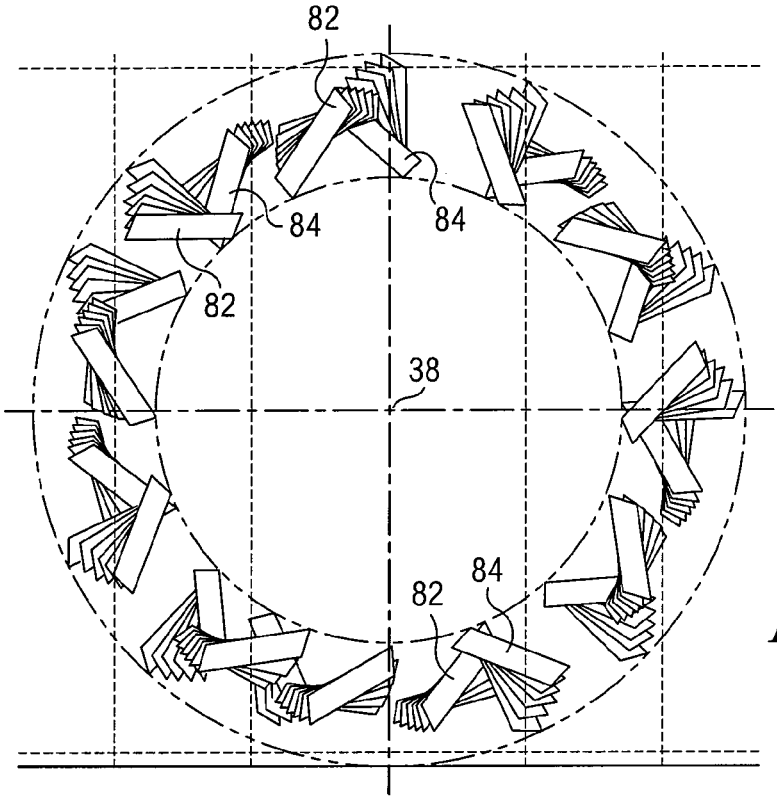
FIG. 14A is a graph showing one example of a pattern of void spaces formed at the bottom of a wellbore by roller cone incorporating teachings of the present invention.

FIG. 14A is a schematic representation showing the effect of craters formed in the bottom of a wellbore by a gauge row with alternating crests aligned for optimum removal of formation materials and enhanced penetration of the formation such as gauge row 72 of cone assembly 30*d*. Craters 82 and 84 cooperate with each to form a generally circular ring cut in adjacent portions of a subterranean formation. Resulting craters 82 and 84 indicate that tracking or any tendency of cutting elements 60 in gauge row 72 to engage a previously formed crater has been substantially reduced or eliminated.

Figure 14B:
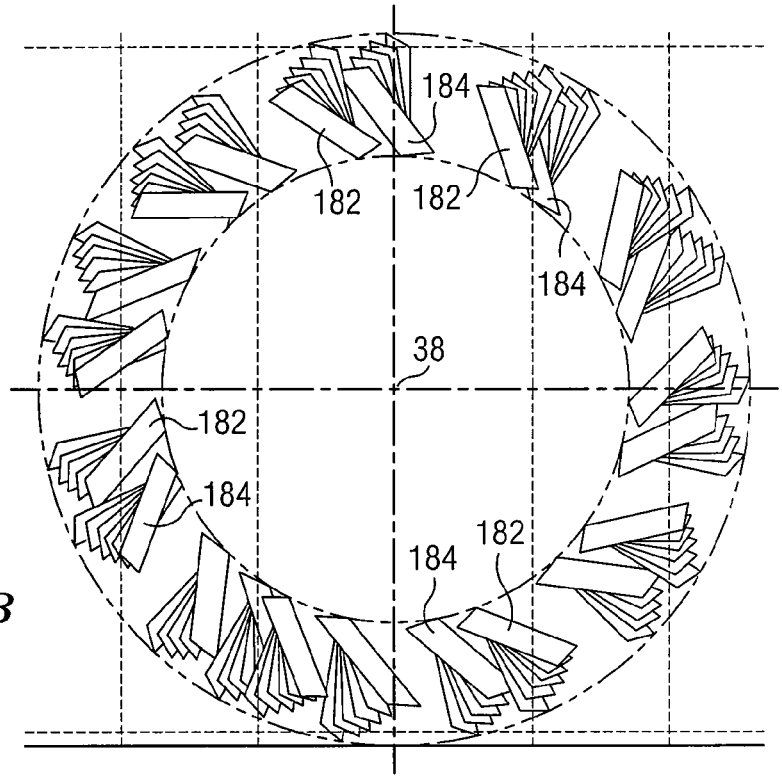
FIG. 14B is a schematic drawing showing one example of a pattern of void spaces which may be formed at the bottom of a wellbore by a conventional roller cone drill bit.

FIG. 14B is a schematic drawing showing one example of a conventional roller cone drill bit having cutting elements disposed in a gauge row at angles which are not optimum angles for formation removal or formation penetration. Craters 182 and 184 formed by such cutting elements may have a tendency to overlap or fall upon each other which results in tracking and reduction in drilling efficiency.

Roller cone drill bit 320 as shown in FIG. 15 preferably includes bit body 324 having tapered, externally threaded portion 22. Bit body 324 preferably includes a passageway (not expressly shown) to communicate drilling mud or other fluids from the well surface through a drill string to attach drill bit 320. Bit body 324 may have three substantially identical support arms 322 extending therefrom. Each support arm preferably includes a respective shaft or spindle (not expressly shown). Cone assemblies 330*a*, 330*b* and 330*c* may be rotatably attached to respective spindles extending from support arms 332. Each cone assembly 330*a*, 330*b* and 330*c* may include a cavity to receive the respective spindle. Each cone assembly 330*a*, 330*b* and 330*c* has a cone rotational axis as previously described with respect to drill bit 20.

Cutting structures may be formed on each cone assembly 330*a*, 330*b* and 330*c* in accordance with teachings of the present invention. For example, cutting elements or teeth 360 may be formed in rows on each cone assembly 330*a*, 330*b* and 330*c* with orientations similar to previously described cutting elements 60. Cutting element 360 may be disposed with crests 368 oriented for optimum penetration of a formation or for optimum removal of formation material as previously described with respect to cutting elements 60. Cutting elements 360 are typically formed using milling techniques. The resulting cutting elements 360 may sometimes be referred to as "milled teeth".

In some embodiments cutting elements 360 may be provided such that the length of crests 368 of alternating milled teeth 360 vary in size. In certain embodiments this includes varying the size of alternating cutting elements 360 such that a larger cutting element having a longer crest 368 may be provided for strength in penetrating hard formations, followed by a smaller cutting element having a shorter crest oriented to maximize formation volume removal.

In some embodiments, cutting elements 360 are formed from the same material as the cone and also include a hard facing applied thereto. Such hard facing may be applied to the entire cutting element 360, to only the leading edge of cutting element 360, or only to the trailing edge of cutting element 360.

FIG. 16 is a schematic drawing in section showing one example of cutting element 360*f* formed with two different types of material in accordance with teachings of the present invention. For some applications relatively hard material 364*a* may be disposed on the trailing portion of cutting element 360*f*. Relatively soft material may be used to form portion 364*b* of cutting element 360*f*. Arrows 381 and 382 show the leading direction and the trailing direction associated with cutting element 360*f*. For other applications relatively hard material may be disposed on the trailing portion of cutting element of 360*f* and the leading portion may be formed from relatively soft materials.

Technical benefits of the present invention include orienting a cutting element for optimum removal of formation materials or for optimum penetration of a formation along with optimum wear of the cutting element. For some types of formation it may be preferable for the leading portion of a cutting element to be formed with relatively hard material as compared with the trailing edge of the cutting element. For other applications it may be preferable to have the leading portion of a cutting element formed from relatively soft material and the trailing portion formed from relatively hard material. This arrangement may result in self sharpening of an associated cutting element.

Although the present invention and its advantages have been described in detail, it should be understood that various changes, substitutions and alternations can be made herein without departing from the spirit and scope of the invention as defined by the following claims.

What is claimed is:

1. A roller cone drill bit comprising:

a bit body having at least one support arm extending therefrom;

a respective cone assembly rotatably mounted on each support arm for engagement with a subterranean formation to form a wellbore;

each cone assembly having at least one row of cutting elements;

each cutting element having a crest extending from the respective cone assembly;

each cutting element having a first portion and a second portion with the associated crest disposed therebetween;

the first portion of the at least one cutting element having a relatively greater concentration of hard material;

the second portion of the at least one cutting element having a reduced concentration of hard material as compared with the first portion of the at least one cutting element; and at least one cone assembly wherein, at least one row of cutting elements is oriented such that the crest of each cutting element is generally perpendicular to an associated scraping direction; and at least another row of cutting elements is oriented such that the crest of each cutting element is generally parallel to the associated scraping direction.

2. drill bit of claim 1 further comprising the first portion of the at least one cutting element corresponding with a leading portion of the at least one cutting element.

3. The drill bit of claim 1 further comprising the first portion of the at least one cutting element corresponding with a trailing portion of the at least one cutting element.

4. The drill bit of claim 1 further comprising the cutting elements selected from the group consisting of inserts and milled teeth.

5. The drill bit of claim 1 further comprising the relatively hard material selected from the group consisting of polycrystalline diamond, tungsten carbide, metal borides, metal oxides, metal carbides and metal nitrides.

6. The drill bit of claim 1 further comprising a leading portion of the at least one cutting element having the reduced concentration of hard material and a trailing portion of the at least one cutting element having the greater concentration of hard material resulting in the at least one cutting element being self sharpening.

7. A roller cone drill bit comprising:

a bit body having at least one support arm extending therefrom;

a respective cone assembly rotatably mounted on each support arm for engagement with a subterranean formation to form a wellbore;

each cone assembly having at least one row of inserts;

each insert having a crest extending from the associated cone assembly for engagement with adjacent portions of the formation;

each cone assembly and associated inserts having a scraping direction for optimum removal of formation materials;

each insert having a leading edge and a trailing edge defined in part by impact with a formation;

at least one insert having a first portion and a second portion;

the first portion of the at least one insert formed from relatively hard materials as compared with materials used to form the second portion;

at least one cone assembly wherein, at least one row of inserts is oriented such that the crest of each insert is generally perpendicular to an associated scraping direction; and at least another row of inserts is oriented such that the crest of each insert is generally parallel to the associated scraping direction.

8. The drill bit of claim 7 further comprising the first portion of the at least one insert disposed adjacent to the associated leading edge.

9. The rotary cone drill bit of claim 7 further comprising the first portion of the at least one insert disposed adjacent to the associated trailing edge.

10. The drill bit or claim 7 further comprising the relatively hard material selected from the group consisting of polycrystalline diamond, tungsten carbide, metal borides, metal oxides, metal carbides and metal nitride.

11. A roller cone drill bit comprising:

a bit body having at least one support arm extending therefrom;

a respective cone assembly rotatably mounted on each support arm for engagement with a subterranean formation to form a wellbore;

each cone assembly having at least one row of inserts;

each insert having a crest extending from the associated cone assembly for engagement with adjacent portions of the formation;

each cone assembly and associated inserts having a scraping direction for optimum removal of formation materials;

each insert having a leading edge and a trailing edge defined in part by impact with a formation;

at least one insert having a first portion and a second portion;

the first portion of the at least one insert formed from relatively hard materials as compared with materials used to form the second portion;

respective crests of inserts disposed in a gauge row of at least one cone assembly arranged generally perpendicular to an associated scraping direction;

respective crests of inserts disposed in a second row of cuffing elements of the at least one cone assembly arranged generally parallel to the associated scraping direction; and respective crests of inserts disposed in a third row of cutting elements oriented generally perpendicular to the associated scraping direction.

12. A roller cone drill bit comprising:

a bit body having three support arm extending therefrom;

a respective cone assembly rotatably mounted on each support arm for engagement with a subterranean formation to form a wellbore;

each cone assembly having at least one row of inserts;

each insert having a crest extending from the associated cone assembly for engagement with adjacent portions of the formation;

each insert having a leading edge and a trailing edge defined in part by impact with a formation;

at least one insert having a first portion and a second portion;

the first portion of the at least one insert formed from relatively hard materials as compared with materials used to form the second portion;

first, second and third cone assemblies rotatably mounted on respective support arms;

a respective crest for each insert in a gauge row of the first cone assembly oriented generally perpendicular to an associated scraping direction;

the respective crest for each insert in a gauge row of the second cone assembly oriented generally parallel to the associated scraping direction; and the respective crest of each insert in a gauge row of the third cone assembly arranged in an alternating pattern defined in part by the crest of one of the inserts oriented generally perpendicular to the associated scraping direction and the crest of the adjacent inserts oriented generally parallel to the associated scraping direction.

13. A method for forming a roller cone drill bit comprising:

forming a bit body with at least three support arms extending therefrom;

forming a respective cone assembly operable to be rotatably mounted on each support arm;

forming a plurality of inserts with each insert having a longitudinal crest along with a respective leading portion and trailing portion;

forming each insert with a greater concentration of hard material adjacent to the leading portion to provide enhanced resistance to abrasion and wear of the insert during contact with a formation;

respective longitudinal crests of a portion of the cutting elements aligned generally parallel with an optimum scraping direction to enhance formation penetration whereby the leading portions of such cutting elements formed from hard material have an increased downhole drilling life; and respective longitudinal crests of another portion of the cutting elements aligned generally perpendicular with an optimum scraping direction to enhance formation removal whereby the leading portions of such cutting elements formed from hard material have an increased downhole drilling life.

14. A method for forming a roller cone drill bit comprising:

forming a bit body with at least three support arms extending therefrom;

forming a respective cone assembly operable to be rotatably mounted on each support arm;

forming a plurality of inserts with each insert having a respective leading portion and a respective trailing portion;

forming each insert with a greater concentration of hard material adjacent to the leading portion to provide enhanced resistance to abrasion and wear during contact with a formation;

forming at least a first row of cutting elements and a second row of cutting elements on each cone assembly with a respective crest extending from each cutting element for engagement with adjacent portions of the formation;

orienting the crest of cutting elements in the first row generally perpendicular relative to an optimum scraping direction for removal of formation materials by the cutting elements of the first row;

orienting the crest of cutting elements in the second row in a direction generally parallel with the optimum scraping direction to enhance penetration of the formation by the cutting element of the second row; and the leading portion of each insert with the greater concentration of hard materials making initial contact with the formation.

* * * * *